US008789504B2

(12) United States Patent
Scheidig

(10) Patent No.: US 8,789,504 B2
(45) **Date of Patent: *Jul. 29, 2014**

(54) CAMSHAFT ADJUSTER

(75) Inventor: Gerhard Scheidig, Oberasbach (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 65 days.

This patent is subject to a terminal disclaimer.

(21) Appl. No.: 13/489,649

(22) Filed: Jun. 6, 2012

(65) Prior Publication Data

US 2012/0318221 A1 Dec. 20, 2012

(30) Foreign Application Priority Data

Jun. 16, 2011 (DE) ..... 10 2011 077 587

(51) Int. Cl.
*F01L 1/34* (2006.01)
*F01L 1/344* (2006.01)

(52) U.S. Cl.
CPC ..... *F01L 1/3442* (2013.01)
USPC ..... 123/90.17

(58) Field of Classification Search
USPC ..... 123/90.15, 90.17
See application file for complete search history.

(56) References Cited

U.S. PATENT DOCUMENTS

| | | | | |
|---|---|---|---|---|
| 6,666,181 | B2 | 12/2003 | Smith et al. | |
| 7,318,401 | B2 * | 1/2008 | Pluta et al. | 123/90.17 |
| 2002/0000213 | A1 * | 1/2002 | Fukuhara et al. | 123/90.17 |
| 2012/0111295 | A1 * | 5/2012 | Plate et al. | 123/90.15 |
| 2012/0227693 | A1 * | 9/2012 | Scheidig | 123/90.15 |
| 2012/0266834 | A1 * | 10/2012 | Scheidig | 123/90.17 |

* cited by examiner

*Primary Examiner* — Thomas Denion
*Assistant Examiner* — Steven D Shipe
(74) *Attorney, Agent, or Firm* — Volpe and Koenig, P.C.

(57) ABSTRACT

An arrangement of a camshaft adjuster (1) having a control device (4) which allows a selection to be made between an OPA and/or a CTA mode. The camshaft adjuster (1) has a third hydraulic medium duct CC which positions the camshaft adjuster (1) in a central position.

10 Claims, 8 Drawing Sheets

P
19
20
23
22
21
2
$AT_0$
$BT_0$
BT
BP
16
AP
1,4
AT
T
CC
BB
AA
10
24
25
7
6
5
AT
AP
BP
BT
$AT_0$
$BT_0$
Q (L/MIN)
0%
20%
40%
60%
80%
100%
I(A)

1,4
2
16
BP
BT
P
19
23
20
22
21
AT
AP
AA
BB
CC
10
5
6
25
7
24
$AT_0/BT_0$
T
Q (L/MIN)
I(A)
0%
20%
40%
60%
80%
100%
$AT_0$
$BT_0$

CAMSHAFT ADJUSTER

CROSS-REFERENCE TO RELATED APPLICATIONS

This application claims the benefit of German Patent Application No. 102011077587.0, filed Jun. 16, 2011, which is incorporated herein by reference as if fully set forth.

FIELD OF THE INVENTION

The invention relates to a camshaft adjuster.

BACKGROUND OF THE INVENTION

Camshaft adjusters are used in internal combustion engines for varying the timing of the combustion chamber valves. The adaptation of the timing to the present load and rotational speed reduces fuel consumption and emissions. A widely used design is the vane-type adjuster. Vane-type adjusters have a stator, a rotor and a drive input wheel. The rotor is usually connected in a rotationally conjoint manner to the camshaft. The stator and the drive input wheel are likewise connected to one another, wherein the rotor is coaxial with respect to the stator and is situated within the stator. The rotor and stator form oil chambers (vane cells) which can be charged with oil pressure and permit a relative movement between the stator and rotor. Furthermore, the vane-type adjusters have a variety of sealing covers. The assembly of stator, drive input wheel and sealing cover is formed by multiple screw connections.

A camshaft adjuster is known from U.S. Pat. No. 6,666,181 B2. The rotor 30, the drive output element, has a bypass in addition to the known hydraulic medium ducts. The bypass conveys the displaced hydraulic medium from a working chamber into the oppositely acting working chamber. When the bypass is covered by the stator, the drive input element, hydraulic medium flow is stopped. The rotor is now situated in the central position. The bypass is controlled by a control piston which can enable or block the hydraulic medium flow from a bypass to a hydraulic medium duct. The conventional hydraulic medium ducts are equipped, in a known way, with check valves in order to utilize the alternating camshaft torques for adjustment, in that, at the time of an alternating camshaft torque, the hydraulic medium volume to be displaced is diverted from one working chamber into the oppositely acting working chamber. In the corresponding axial position of the control piston, those hydraulic medium ducts which permit said transfer in the desired adjustment direction of the rotor are connected into the hydraulic medium flow.

SUMMARY

It is an object of the invention to specify a camshaft adjuster which makes it possible for an intermediate position to be attained.

This objective is met with a device according to the invention.

It is achieved in this way that the positioning element can be placed into an intermediate position between its extreme positions by a control device, in particular a central valve, which selectively permits the utilization of alternating camshaft torques (CTA mode) and/or the utilization of the hydraulic medium pressure (OPA mode). In the extreme positions of the positioning element, the positioning element is in contact with the stop. One working chamber has a maximum volume, whereas the oppositely acting working chamber has a minimal volume or zero volume. The intermediate position is, in the ideal situation, the central position. The special feature lies in the design and mode of operation of the central valve, which comprises a valve housing, a valve sleeve and a control piston. The valve housing rotates synchronously with the camshaft and has an orifice arrangement of bores, windows, slots, grooves and the like on its circumference. Arranged coaxially thereto is situated the valve sleeve, likewise having a plurality of bores, windows, slots, grooves and the like on its circumference. The valve sleeve is prevented from rotating about the camshaft axis by positive locking or the like. The relative rotation of the valve housing and valve sleeve causes certain passage openings to be connected, in a positively controlled and predefined manner, into a hydraulic medium flow as a function of the camshaft angle, wherein the throughflow in the predominantly radial direction is permitted or blocked by the two components. The control piston which is arranged coaxially with respect to the valve sleeve permits or blocks, by its axial position relative to the valve sleeve, the hydraulic medium flow of the orifice arrangement of the valve sleeve at the inner diameter of the valve sleeve by means of the control edges or orifices formed on the control piston. The control piston can be actively controlled in terms of its axial position by a central magnet. In the deenergized or non-activated state, the control piston can be moved into its rest position by means of a restoring spring, usually a compression spring.

According to the invention, the camshaft adjuster has a third hydraulic medium duct which, in addition to the two already known hydraulic medium ducts explicitly assigned to each working chamber, is arranged such that the positioning element can be moved into an intermediate position, in a special case the central position. According to the invention, therefore, in addition to the known Q-I characteristic curve (throughflow of volume of a hydraulic medium vs. energization/control piston position), a further position of the control piston is available. It is thereby possible with said camshaft adjuster, by which an active selection can be made between an OPA mode and a CTA mode, for the positioning element to be positioned in an intermediate position.

In one embodiment of the invention, the third hydraulic medium duct opens into each working chamber. Here, the third hydraulic medium duct may be branched between the openings into the working chambers and the central valve. This third hydraulic medium duct is advantageously arranged in the rotor, stator or in one of the side covers. In the intermediate position, the openings are covered by the positioning element, such that a hydraulic medium flow is no longer possible. Such an arrangement reduces production outlay, because the groove or opening can be easily milled or drilled. In the case of a sheet-metal stator or side cover which has the groove, the latter may be deep-drawn or stamped. Whether or not the opening communicates with the working chamber is dependent on the rotational position of the positioning element.

If the control piston is in the position required for the intermediate position, then the hydraulic medium flow through the predefined orifice arrangement of the valve sleeve is connected to the orifices of the valve housing such that alternating charging of the working chambers takes place, for example at 180° and 0° camshaft angle. Here, the time or the angle is synchronized with the camshaft torques transferred into the camshaft by the valve drive. While one working chamber is pressurized, the hydraulic medium of the other working chamber in each case is enclosed or discharged to the tank. This alternate opening and closing is realized by the positive control, mentioned in the introduction, between the valve sleeve and valve housing. Here, the third hydraulic medium duct is either connected to the tank, that is to say to the outflow, or is hydraulically deactivated depending on the position of the control piston.

In the case of an arrangement of the third hydraulic medium duct in the drive output element, in particular the rotor, for a central position, each opening of the third hydraulic medium duct is arranged symmetrically with respect to the positioning element at uniform circumferential intervals.

In the case of an arrangement of the third hydraulic medium duct in the drive output element, in particular in the stator or in the side cover, the spacings between the openings and the extreme positions or the stop surfaces of the positioning element must be of equal magnitude.

If the positioning element is situated in an extreme/stop position, at least one opening of the third hydraulic medium duct is open to the working chamber with the greater volume. If an adjustment into the intermediate position or central position is now sought, the control piston is moved into the axial position provided for this purpose. Here, the third hydraulic medium duct is in hydraulic medium connection with the outflow or tank at least over a certain camshaft angle range, preferably over one complete camshaft rotation. One of the two known hydraulic medium ducts is now pressurized while the other in each case is closed. This takes place in an alternating fashion as a function of the camshaft angle, preferably synchronously with the arising alternating camshaft torque in the direction resulting from the pressurization used. The working chamber with the greater volume which is to be reduced in size in order to attain the intermediate or central position has an open connection to the tank via the opening of the third hydraulic medium duct. In this way, the hydraulic medium can flow out, and the positioning element moves in the direction of the intermediate or central position. This process is completed when the intermediate or central position is reached, because in said position of the positioning element, both openings of the third hydraulic medium duct to the two working chambers are positively closed off by being covered by a lateral component. If, proceeding from the intermediate position of the positioning element, an alternating camshaft torque acts in a certain rotational direction, the positioning element is hydraulically supported by the substantially incompressible hydraulic medium in the working chamber with the volume to be decreased, and the resulting rotational movement is thereby inhibited.

The camshaft adjuster is thereby advantageously damped in its intermediate or central position, which results in extremely stable reproducibility of the timing and therefore, during the starting phase of the engine, attains a very good starting capability of the engine as a result of fast attainment and stable holding of the intermediate position (=start position).

In the case of engines with relatively high friction torques of the camshaft, it is possible by use of the predefined advantageous design of the central valve for the third hydraulic medium duct to be pressurized counter to the drag torque at the moment at which this drag torque acts. In this way, in such engines, the intermediate or central position is stabilized, and damaging fluctuations are avoided.

In one embodiment of the invention, the axial positions of the control piston are assigned, with increasing energization proceeding from the deenergized position, the following sequence of modes: intermediate or central position, OPA mode (advanced toward retarded), CTA mode (advanced toward retarded), regulated position, CTA mode (retarded toward advanced), OPA mode (retarded toward advanced).

In an alternative embodiment of the invention, the axial positions of the control piston are assigned, with increasing energization proceeding from the deenergized position, the following sequence of modes: intermediate or central position, OPA mode (retarded toward advanced), CTA mode (retarded toward advanced), regulated position, CTA mode (advanced toward retarded), OPA mode (advanced toward retarded).

Here, the intermediate or central position of the positioning element is defined predominantly by the arrangement of the third hydraulic medium duct and the openings thereof into the working chambers. The OPA mode is characterized by the pressurization of a working chamber whose volume is to be increased and by evacuation of the working chamber whose volume is to be decreased. The evacuation is realized through an orifice to the tank or to the outflow. The CTA mode utilizes alternating camshaft torques, as a result of which the pressure in one working chamber is increased, which pressure is however discharged to the other working chamber which experiences a negative pressure. The action of the oppositely acting alternating camshaft torque is suppressed by the prevention of the return flow. The positioning element is thus adjusted in a stepped manner in one direction. The regulated state is based on the principle that the working chambers are alternately pressurized, and the respective other is closed at this moment and serves as a supporting hydraulic cushion. In this way, any position of the positioning element between the extreme positions can be hydraulically held and fixed. During an adjustment demanded by the control unit, both in the intermediate or central position mode and also in the OPA or CTA mode, both effects are utilized, the hydraulic medium pressure in combination with the alternating camshaft torques, wherein both effects are synchronized with one another in the directionally active moment.

In an alternative embodiment of the invention, the modes begin with the fully energized state of the central magnet, or of its action on the control piston, that is to say in the following sequence: intermediate or central position, OPA mode (retarded toward advanced), CTA mode (retarded toward advanced), regulated position, CTA mode (advanced toward retarded), OPA mode (advanced toward retarded).

In an alternative embodiment of the invention, the modes begin with the fully energized state of the central magnet, or of its action on the control piston, that is to say in the following sequence: intermediate or central position, OPA mode (advanced toward retarded), CTA mode (advanced toward retarded), regulated position, CTA mode (advanced toward advanced), OPA mode (advanced toward advanced).

Likewise possible are modes which exhibit either only OPA or only CTA functionality in conjunction with the functionality of ensuring the intermediate position, for example in the following sequences:

- intermediate or central position, OPA mode (retarded toward advanced), regulated position, OPA mode (advanced toward retarded), or
- intermediate or central position, OPA mode (advanced toward retarded), regulated position, OPA mode (retarded toward advanced), or
- intermediate or central position, CTA mode (advanced→retarded), regulated position, CTA mode (retarded→advanced), or
- intermediate or central position, CTA mode (retarded→advanced), regulated position, CTA mode (advanced→retarded).

In a preferred embodiment, the positioning element is mechanically locked in the intermediate or central position. This increases the reliability with which the various other operating modes are initiated proceeding from the intermediate or central position during an engine start. This mechanical locking is locked when hydraulic medium pressure is low or non-existent, and unlocks when the engine oil pressure increases. It is furthermore advantageous that, during the shut-down of the engine, the positioning element is, according to the invention, positioned in the intermediate or central position and mechanically locked.

In a further embodiment of the invention, the camshaft adjuster has a restoring spring which assists the positioning element in an adjustment direction or acts counter to the drag torque or the friction torque of the camshaft. The restoring spring advantageously acts so as to assist the attainment of the intermediate or central position.

Through an embodiment according to the invention, a camshaft adjuster is provided which, in a positively controlled manner (by the relative rotation between the valve housing and valve sleeve), can attain an intermediate or central position of the positioning element by synchronization of hydraulic medium pressure with alternating camshaft torques, and hold this position. Furthermore, an extremely fast adjustment is attained as a result of the arrangement of a third hydraulic medium duct which opens at least once into each working chamber. The third hydraulic medium duct permits a geometrically predefined position of the positioning element.

BRIEF DESCRIPTION OF THE DRAWINGS

Exemplary embodiments of the invention are illustrated in the Figures, in which.

DETAILED DESCRIPTION OF THE PREFERRED EMBODIMENTS

Figure 1:
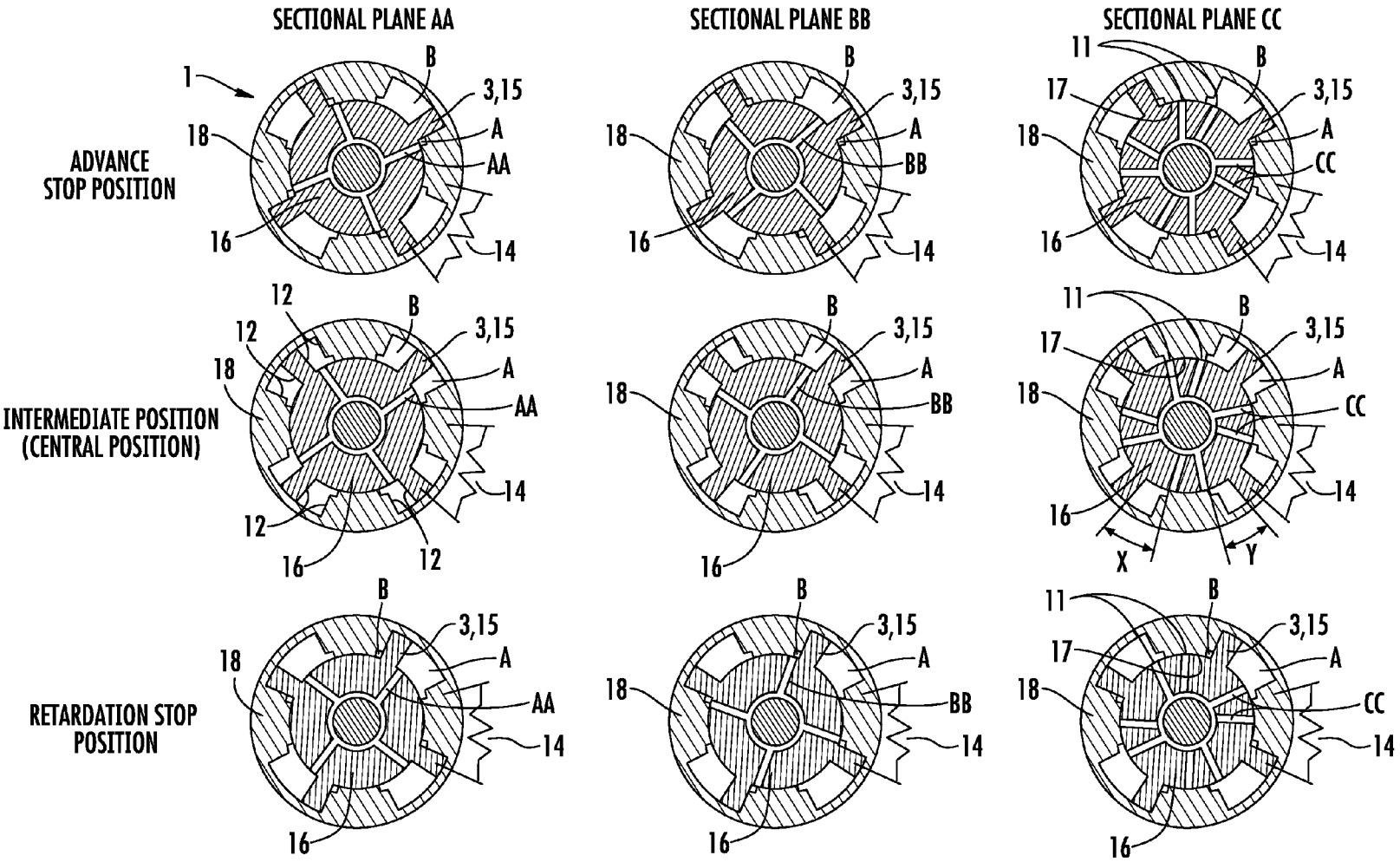
FIG. 1 shows an overview of sectional planes through the hydraulic medium ducts of the camshaft adjuster with the different positions of the positioning element.

FIG. 1 shows an overview of the sectional planes through the hydraulic medium ducts AA, BB, CC of the camshaft adjuster 1 with the different positions of the positioning element 3. The positioning element 3 can assume 3 positions: "advance stop", "intermediate position" and "retardation stop". Here, "advance stop" and "retardation stop" are arbitrarily named exemplary stop positions which are dependent on the definition of the adjustment direction of the camshaft adjuster 1. Likewise, the sequence of the axial arrangement of the hydraulic medium ducts is selected merely by way of example.

The positioning element 3 is formed here as a vane 15 of a drive output element 16, for example of a rotor. The drive input element 18, for example a stator, likewise has vanes 15 which extend in the radial direction and which, together with the vanes 15 of the drive output element 16, define the working chambers A and B. When the volume of the working chamber A is at a minimum, the positioning element 3 is situated at an "advance stop". When the volume of the working chamber B is at a minimum, then the positioning element 3 is situated at a "retardation stop". The hydraulic medium duct AA supplies hydraulic medium to the working chamber A, whereas the hydraulic medium duct BB provides a supply to the working chamber B. The hydraulic medium duct CC has two openings 11 which, depending on the position of the positioning element, are in fluid-conducting connection with one working chamber A or B. Here, in an "intermediate position", the openings 11 are closed off.

In this example, the drive output element 16 has the hydraulic medium duct CC, wherein the hydraulic medium duct CC may alternatively be situated in the drive input element 18 or in a side cover (not illustrated). The opening of the hydraulic medium duct AA into the working chamber A is at the smallest possible distance from the vane 15 of the drive output element 16. Likewise, the opening of the hydraulic medium duct BB is at the smallest possible distance from the vane 15 of the drive output element 16. This smallest possible distance permits charging of the working chamber A or B at an "advance stop" and "retardation stop" respectively. The openings 11 of the hydraulic medium duct CC are ideally situated a substantially equal distance from a stop surface 12 of a respective vane 15 of the drive output element 16. The openings 11 of the hydraulic medium duct CC need not, for this purpose, be in the same axial sectional plane CC, but rather may also be arranged offset in the axial direction.

When the positioning element 3 is situated at the "advance stop", a first opening 11 of the hydraulic medium duct CC is covered by a vane 15 of the drive input element such that virtually no hydraulic medium flow takes place through said first opening 11. Here, the second opening 11 of the hydraulic medium duct CC is open to the working chamber B.

When the positioning element 3 is situated at the "retardation stop", the second opening 11 of the hydraulic medium duct CC is covered by a vane 15 of the drive input element such that virtually no hydraulic medium flow takes place through said opening 11. Here, the first opening 11 of the hydraulic medium duct CC is open to the working chamber A. The total number of openings 11 of the hydraulic medium duct CC may be varied for optimization of the hydraulic medium flow.

When the positioning element 3 is situated in the "intermediate position", both openings 11 of the hydraulic medium duct CC are covered by a vane 15 of the drive input element such that virtually no hydraulic medium flow takes place through said openings 11. A hydraulic medium flow can therefore be realized only through the hydraulic medium ducts A and B. Here, it is advantageously possible to attain a large adjustment angle by a small spacing between the openings 11 and therefore a small circumferential surface 17 of the vane 15 of the drive input element 18.

Figure 2:
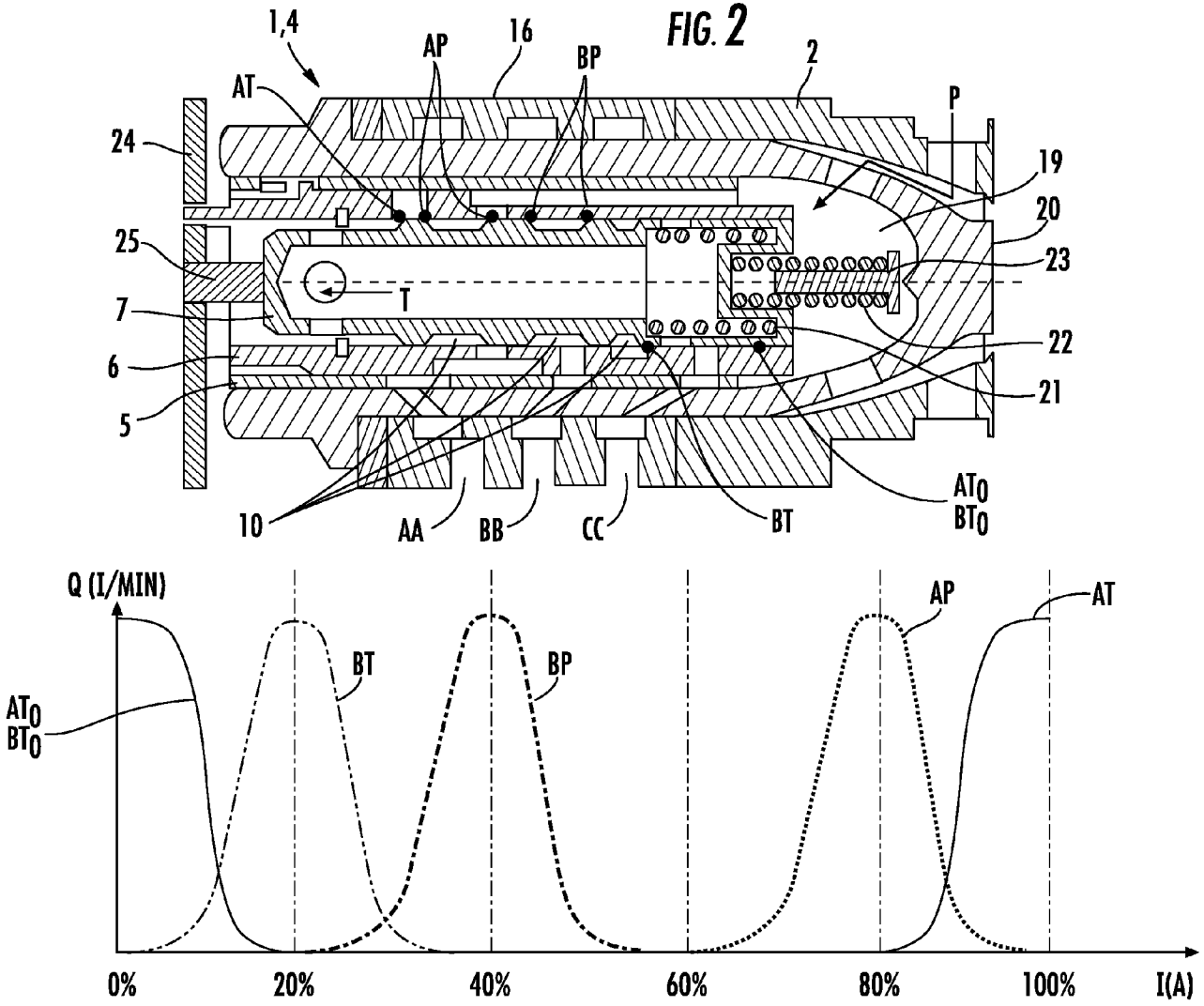
FIG. 2 shows a section through a first exemplary embodiment of the control device, with the corresponding Q-I characteristic curve.

FIG. 2 shows a section through a first exemplary embodiment of the control device 4 with the corresponding Q-I characteristic curve. The control device 4 is situated concentrically within a cavity 19 of a central screw 20. The control device 4 comprises a valve housing 5, a valve sleeve 6, a compression spring 21 and a control piston 7. Furthermore, the control device 4 may additionally have a further compression spring 22 and a centering pin 23 and also, on the side remote from the camshaft, a central magnet 24 (not illustrated in any more detail) with an actuating pin 25. When the central magnet 24 is energized, the actuating pin 25 displaces the control piston 7 in the axial direction counter to the spring force of the compression spring 21. The centering pin 23 and the compression spring 22 push the valve sleeve 6 toward the central magnet 24, such that the positive locking for blocking the rotation of the valve sleeve 6 is maintained. The Q-I characteristic curve shows the different volume flows of the hydraulic medium over the control edges, denoted by AT, AP, BP, BT and $AT_0BT_0$, at the axial positions of the control piston.

In the illustrated position of the control piston 7, the control edge AT is fully open and permits a maximum hydraulic medium flow ("Q" on the ordinate). At the same time, the energization of the central magnet is 100% ("I" on the abscissa), and the actuating pin 25 of said central magnet is at maximum stroke. This mode is the OPA mode, because the working chamber A is connected to the tank and the working chamber B is connected to the pump P. At 80% energization, the AT control edge is closed and the AP control edge is fully open. This mode corresponds to the CTA mode, wherein an adjustment is effected by the alternating camshaft torques together with the pump P, wherein as a result of the arrangement of the components and orifices of the control device 4, one working chamber A or B is alternately pressurized in a manner synchronized with the alternating camshaft torques, whereas the respective other working chamber B or A experiences an alternation of the states of pressurization and volume enclosed in the working chamber. At the time of an alternating camshaft torque in the adjustment direction, the corresponding working chamber is pressurized, whereas by contrast, when the opposing alternating camshaft torque acts, said working chamber is merely closed. At 60% energization, the camshaft adjuster 1 is in the regulated mode, and the positioning element 3 can hold any desired position between "advance stop" and "retardation stop". At 40% energization, that is to say the control edge BP is fully open, the camshaft adjuster is in the CTA mode in the opposite adjustment direction to that in the case of 80% energization. At 20% energization, the camshaft adjuster is in the OPA mode in the opposite adjustment direction to that in the case of 100% energization. At 0% energization, the control edges $AT_0BT_0$ are fully open, wherein the hydraulic medium duct CC has a connection to the tank.

The hydraulic medium duct CC is advantageously open to the tank when the control piston 7 is in the deenergized position. In this way, the hydraulic medium is discharged into the working chambers A or B depending on the position of the positioning element 3, and the working chambers A or B are evacuated until the openings 11 of the hydraulic medium duct CC have been closed off by the vane 15 of the drive input element 18. Since this takes place automatically, this mode is particularly suitable for the starting of the engine. This is because the positioning element 3 may be situated in any position when the engine is shut down. During the shut-down of the engine, the revolutions of the engine from the time of the "key off" signal until the engine actually comes to a standstill are utilized in order, by the arrangement of the hydraulic medium duct CC and the control device 4, to move the positioning element automatically into an intermediate or central position in which the timing of exhaust and intake valves is optimized for a subsequent engine start.

Figure 3:
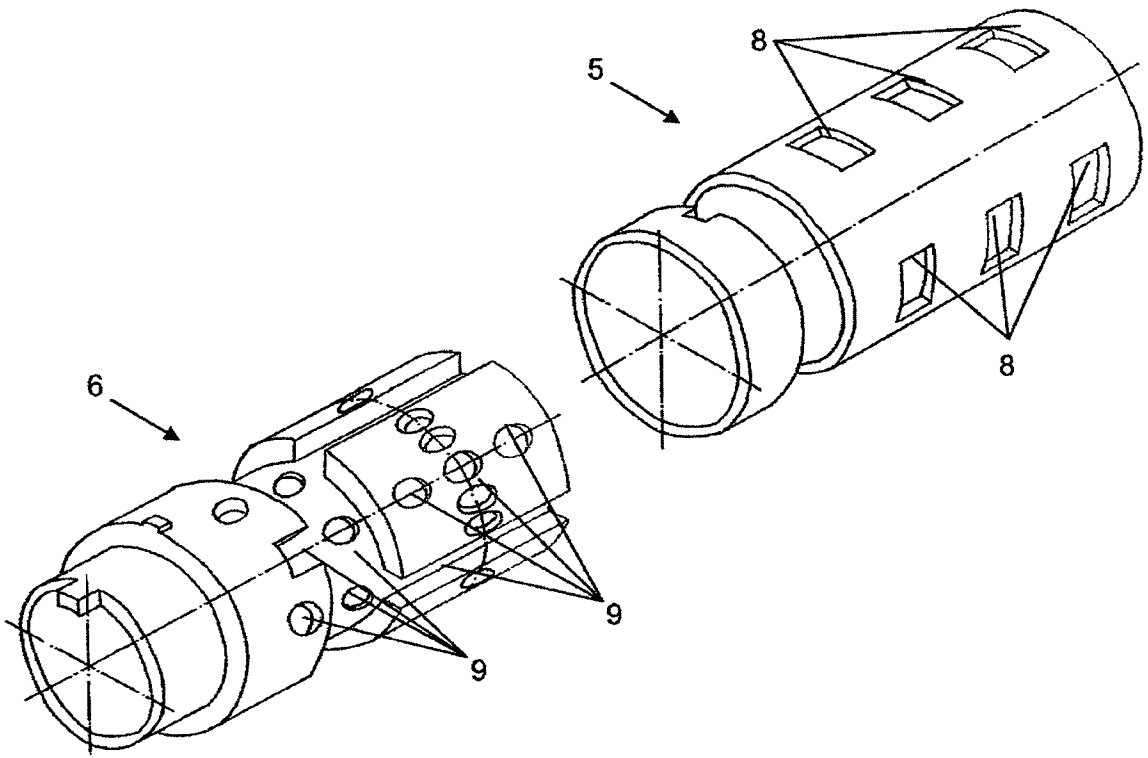
FIG. 3 shows a 3D illustration of the valve housing and of the valve sleeve of the first exemplary embodiment.

FIG. 3 shows a 3D illustration of the valve housing 5 and of the valve sleeve 6 of the first exemplary embodiment. The valve housing 5 has a plurality of circumferentially distributed orifices formed as windows, bores, grooves or similar types of fluid-conducting recesses. The valve sleeve 6 likewise has an orifice arrangement 9 with corresponding windows, bores, grooves or similar types of fluid-conducting recesses. During operation, the valve sleeve 6 is situated concentrically within the valve housing 5, wherein the valve housing 5 is formed rotationally conjointly with the camshaft 2 (not illustrated) and rotates relative to the valve sleeve 6, wherein the valve sleeve 6 is prevented from rotating synchronously with respect to the valve housing 5 by positive locking. In this way, the orifices 8 are opened and closed at time intervals by the orifice arrangement 9 and open or block various hydraulic medium paths to the working chambers A and B and to the control piston 7.

Figure 4:
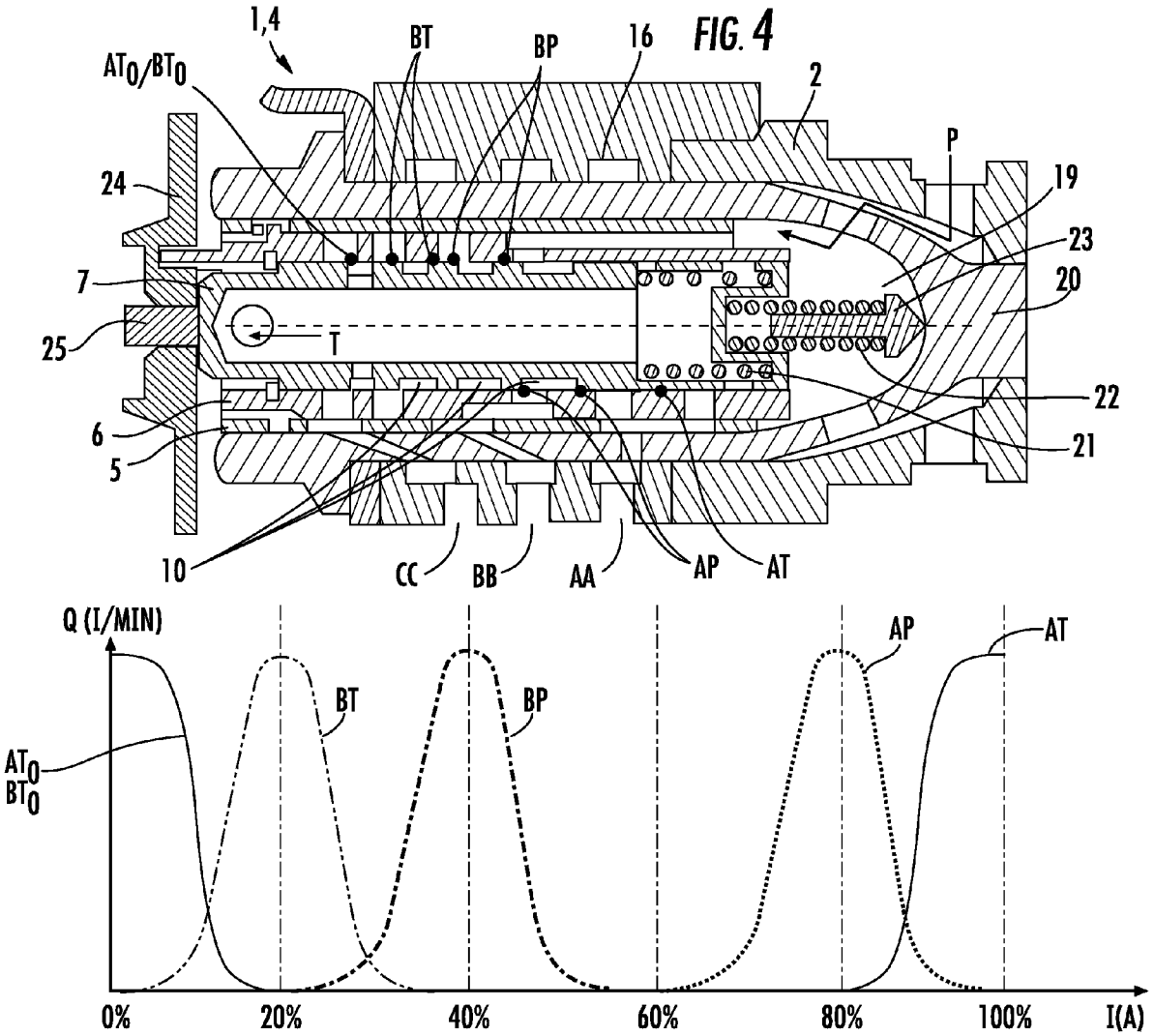
FIG. 4 shows a section through a second exemplary embodiment of the control device, with the corresponding Q-I characteristic curve.

FIG. 4 shows a section through a second exemplary embodiment of the control device 4 with the corresponding Q-I characteristic curve. The control device 4 is situated concentrically within a cavity 19 of a central screw 20. The control device 4 comprises a valve housing 5, a valve sleeve 6, a compression spring 21 and a control piston 7. The control device 4 may furthermore additionally have a further compression spring 22 and a centering pin 23 and, on the side remote from the camshaft, a central magnet 24 (not illustrated in any more detail) with an actuating pin 25. When the central magnet 24 is energized, the actuating pin 25 displaces the control piston 7 in the axial direction counter to the spring force of the compression spring 21. The centering pin 23 and the compression spring 22 push the valve sleeve 6 toward the central magnet 24 in order to maintain the positive locking for blocking the rotation of the valve sleeve 6. The Q-I characteristic curve shows the different volume flows of the hydraulic medium over the control edges, denoted by $AT_0BT_0$, BT, BP, AP and AT, at the axial positions of the control piston.

In the illustrated position of the control piston 7, the control edge $AT_0BT_0$ is fully open and permits a maximum hydraulic medium flow. At the same time, the energization of the central magnet is 0% (on the abscissa) and the actuating pin 25 of said central magnet is at minimum stroke. The mode of operation is basically the same as in the exemplary embodiment of FIG. 2, but with the difference that the hydraulic medium duct CC is arranged on the side remote from the camshaft and the control edge $AT_0BT_0$ is therefore also situated on said side.

Again, it is advantageously the case that the hydraulic medium duct CC is open to the tank when the control piston 7 is in the deenergized position. In this way, the hydraulic medium is discharged into the working chambers A or B depending on the position of the positioning element 3, and the working chambers A or B are evacuated until the openings 11 of the hydraulic medium duct CC have been closed off by the vane 15 of the drive input element 18. Since this takes place automatically, said mode is particularly suitable for the starting of the engine. This is because the positioning element 3 may be situated in any position when the engine is shut down. During the shut-down of the engine, triggered for example by a "key off" signal, as a result of the arrangement of the hydraulic medium duct CC and the control device 4, the positioning element is automatically moved into an intermediate or central position in which the timing of outlet and inlet valves is optimized for an engine start.

Figure 5:
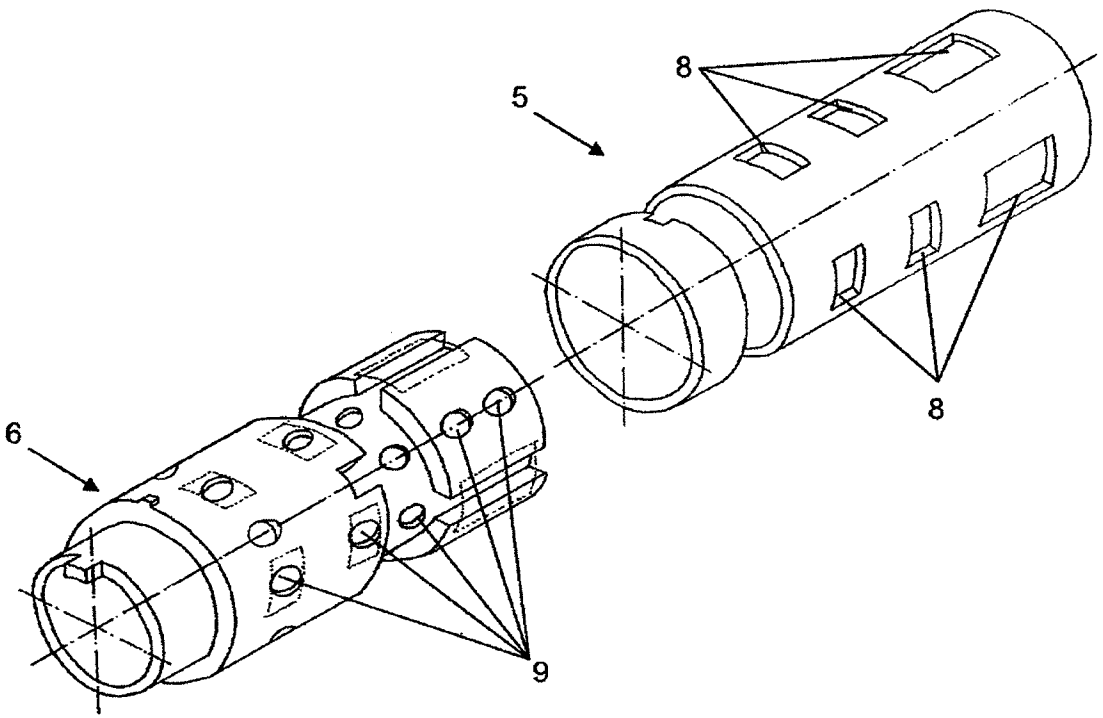
FIG. 5 shows a 3D illustration of the valve housing and of the valve sleeve of the second exemplary embodiment.

The design of the valve housing 5 and of the valve sleeve 6 and also of the control piston 7 differ from the design variant in FIG. 2. The differently designed orifice arrangement 9 of the valve sleeve 6 and the orifices 8 of the valve housing 5 are shown in FIG. 5.

Figure 6:
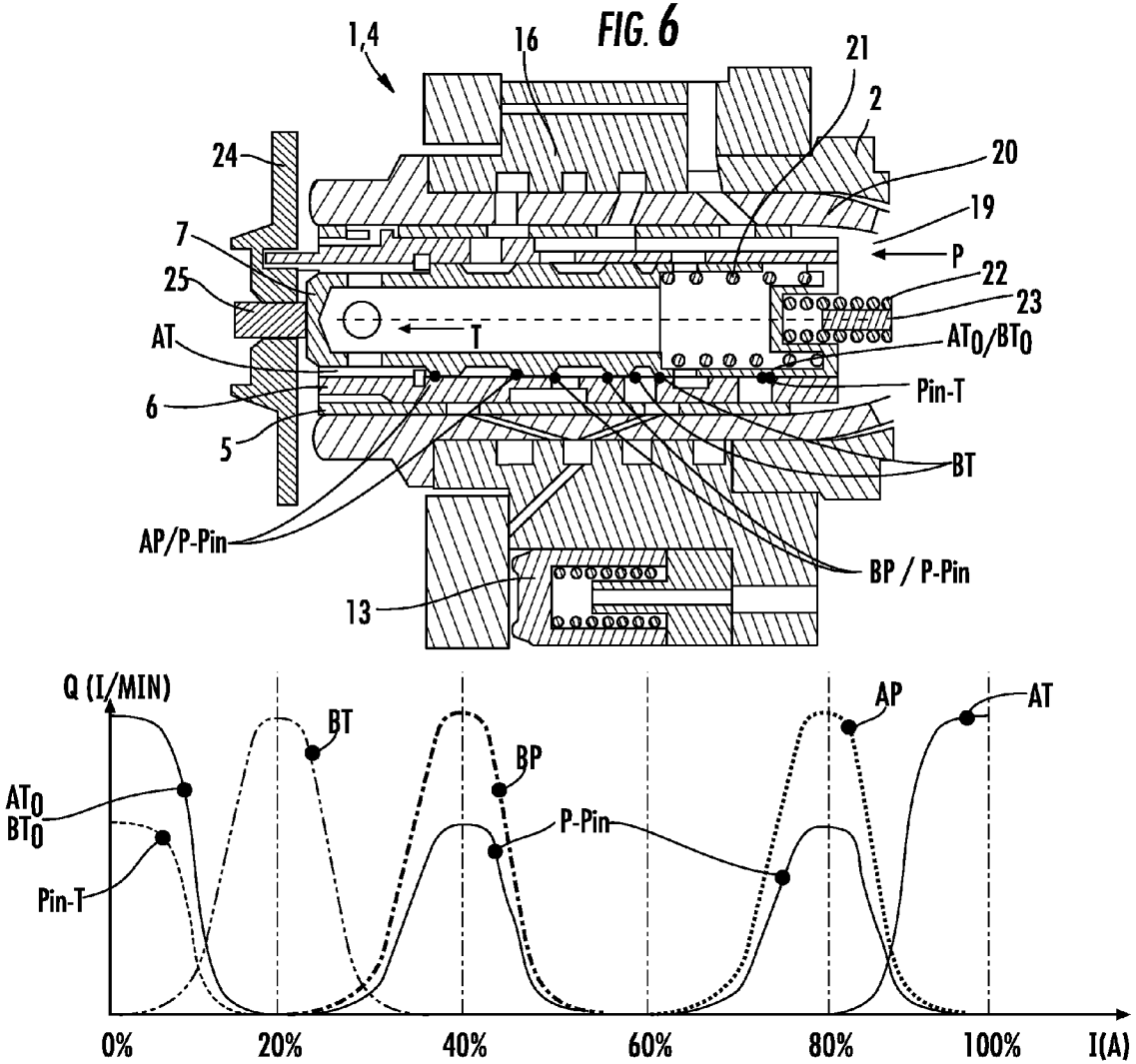
FIG. 6 shows a section through a third exemplary embodiment of the control device, with the corresponding Q-I characteristic curve.

FIG. 6 shows a section through a third exemplary embodiment of the control device 4 with the corresponding Q-I characteristic curve. The mode of operation is basically the same as that in the exemplary embodiments shown in FIG. 2 and FIG. 4, but the functionality has been expanded to include a further hydraulic medium duct for the activation of a locking mechanism 13. The locking mechanism 13 has the components known from the prior art, such as a locking piston for locking into a slot, a compression spring and a sleeve with a ventilation bore for ventilating the spring chamber of the compression spring. It can be seen from the Q-I characteristic curve that, in the deenergized state of the central magnet 24, the control edge $AT_0BT_0$ is open and permits a hydraulic medium flow to the tank. In said axial position of the control piston 7, the locking mechanism 13 is in the unpressurized state, that is to say the compression spring of the locking mechanism 13 pushes the locking piston into a slot, and locks the drive input element 18 to the drive output element 16 in a rotationally conjoint manner. The locking mechanism 13 itself is arranged in a bore of the drive output element 16. The slot (not illustrated) is situated in the drive input element 18. To unlock the drive output element 16 from the drive input element 18, that is to say to permit a rotation of these relative to one another, the control piston 7 is moved into the positions of the CTA mode. The CTA mode is attained by energizing the central magnet with either 40% or 80% current.

Figure 7:
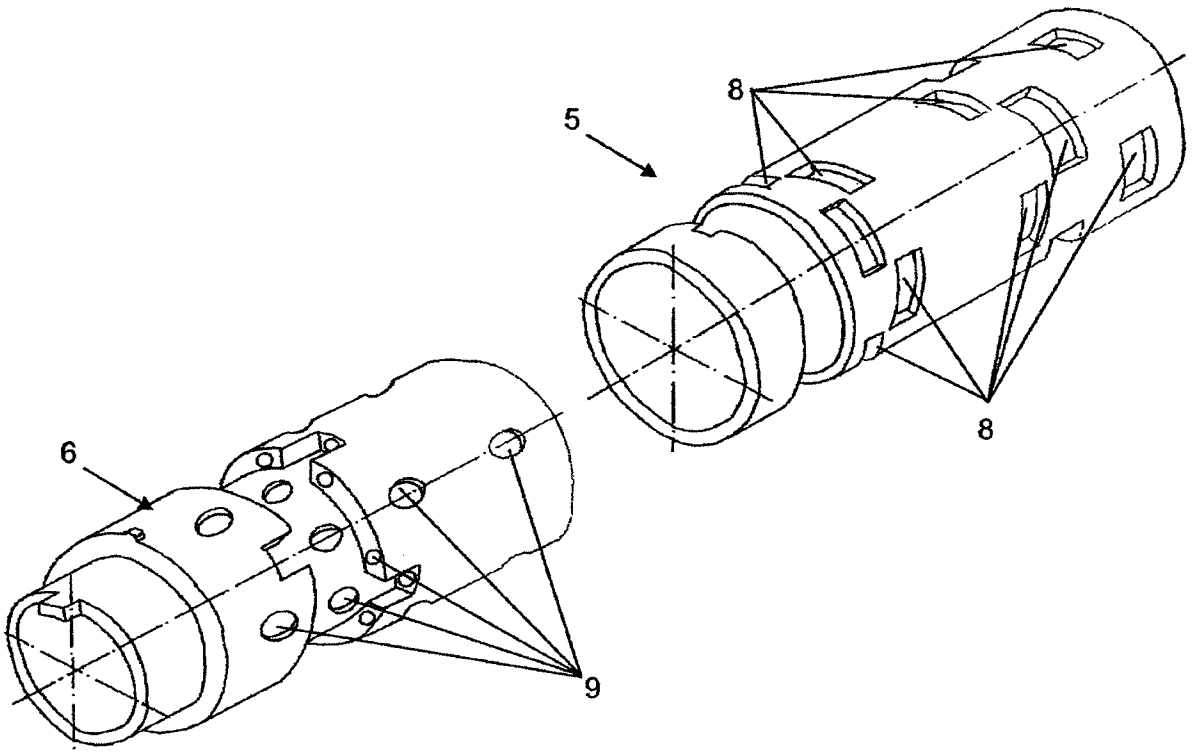
FIG. 7 shows a 3D illustration of the valve housing and of the valve sleeve of the third exemplary embodiment.
Figure 8:
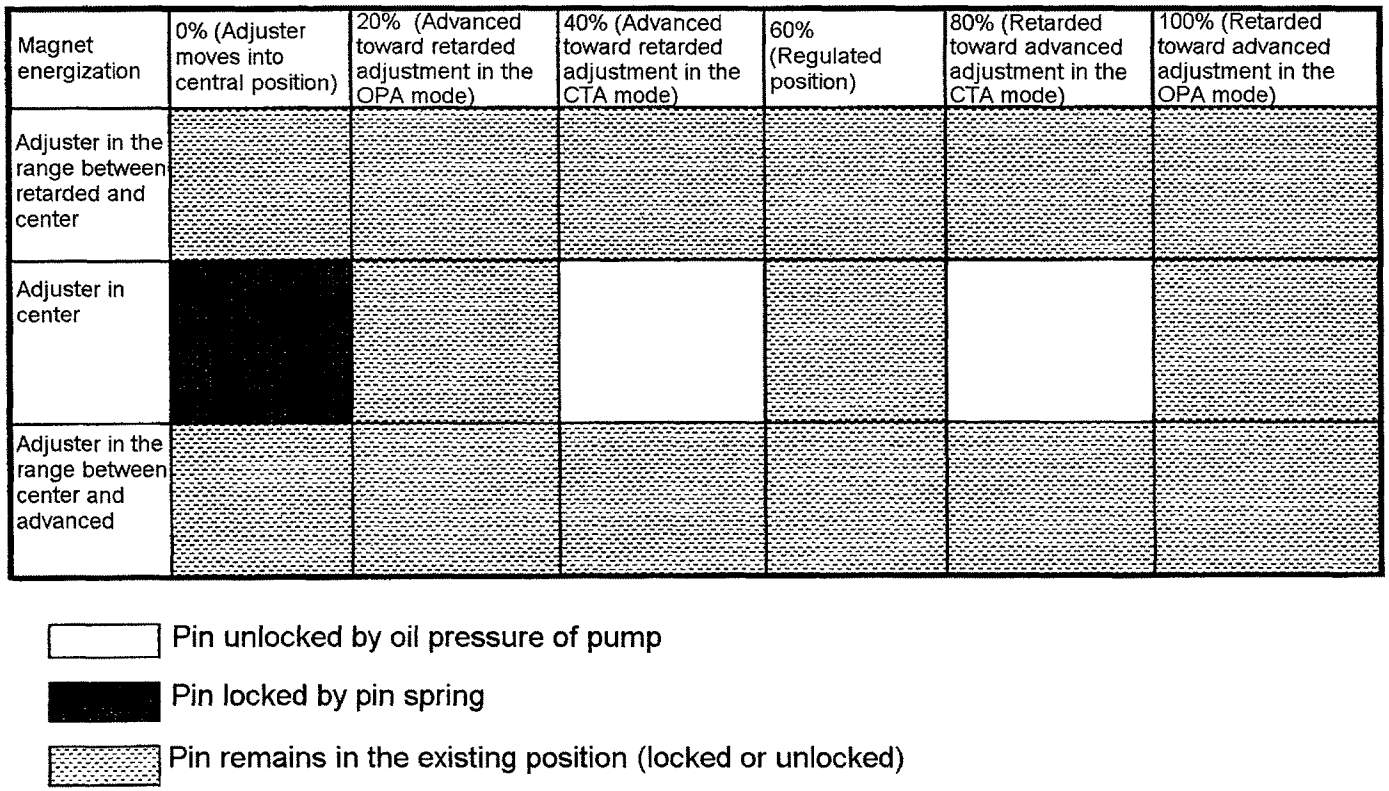
FIG. 8 shows a schematic illustration of the locking states in the third exemplary embodiment.

FIG. 7 shows a 3D illustration of the valve housing 5 to be used and of the valve sleeve 6 of the third exemplary embodiment for the functionality of a locking mechanism 13, while FIG. 8 shows a schematic illustration of the locking states of the third exemplary embodiment. The locking mechanism 13 is locked in the central position of the positioning element 3. Here, the use of the expressions "advanced toward retarded" is defined merely by way of example. It is advantageously possible, by exchanging the control device 4 with the valve housing 5, the valve sleeve 6 and the control piston 7, for the modes to be interchanged in terms of their sequence or for certain modes to be deactivated or suppressed.

LIST OF REFERENCE SYMBOLS

1 Camshaft adjuster
2 Camshaft
3 Positioning element
4 Control device
5 Valve housing
6 Valve sleeve
7 Control piston
8 Orifices
9 Orifice arrangement
10 Orifices
11 Opening
12 Stop surface
13 Locking mechanism
14 Restoring spring
15 Vane
16 Drive output element
17 Circumferential surface
18 Drive input element
19 Cavity
20 Central screw
21 Compression spring
22 Compression spring
23 Centering pin
24 Central magnet
25 Actuating pin
A Working chamber A
B Working chamber B
AA Hydraulic medium duct AA
BB Hydraulic medium duct BB
CC Hydraulic medium duct CC
AB Pressure chamber

The invention claimed is:

1. A camshaft adjuster for a camshaft, comprising a pressure chamber (AB) and an positioning element arranged in the pressure chamber (AB), the positioning element divides the pressure chamber (AB) into a first working chamber (A) and a second working chamber (B), hydraulic medium can be supplied to and discharged from the first working chamber (A) through a first hydraulic medium duct (AA) and supplied to and discharged from the second working chamber (B) through a second hydraulic medium duct (BB), such that the positioning element can be moved, resulting in a rotation of the camshaft, by a pressure difference between the first working chamber (A) and the second working chamber (B), the supply and discharge of the hydraulic medium is controlled by a control device which has a valve housing, a valve sleeve arranged in and rotatable relative to the valve housing, and a control piston axially displaceable within the valve sleeve, the valve housing has orifices which communicate with the first working chamber (A) and the second working chamber (B), the valve housing rotates synchronously with the camshaft and, in the process, the orifices of the valve housing are closed off and opened up by an orifice arrangement formed on the valve sleeve, the orifice arrangement of the valve sleeve communicates with orifices of the control piston as a function of an axial position of the control piston, and the camshaft adjuster has a third hydraulic medium duct (CC) which positions the positioning element in an intermediate position, and the third hydraulic medium duct (CC) has an opening which communicates with one of the working chambers (A, B).

2. The camshaft adjuster as claimed in claim 1, wherein the third hydraulic medium duct (CC) opens into one of the working chambers (A, B) depending on a position of the positioning element during operation of the camshaft adjuster.

3. The camshaft adjuster as claimed in claim 2, wherein the opening of the third hydraulic medium duct (CC) is closed off to the one of the working chambers (A, B) when the positioning element is in the intermediate position.

4. The camshaft adjuster as claimed in claim 1, wherein the third hydraulic medium duct (CC) is arranged in the camshaft adjuster such that, when the positioning element is in a certain position, the opening of the hydraulic medium duct (CC) is covered by the positioning element itself.

5. The camshaft adjuster as claimed in claim 1, wherein a spacing (x) between the opening of the third hydraulic medium duct (CC) and a stop surface has a same size as a spacing (y) between a further opening of the third hydraulic medium duct (CC) and a stop, so that the positioning element assumes a central position.

6. The camshaft adjuster as claimed in claim 2, wherein the hydraulic medium ducts (AA, BB) are pressurized and the third hydraulic medium duct (CC) is open to a tank (T) in order to position the positioning element in the intermediate position.

7. The camshaft adjuster as claimed in claim 1, wherein axial positions of the control piston correspond, with increasing energization of a central magnet proceeding from a deenergized position, to a sequence of modes as follows: intermediate or central position, OPA, CTA, regulated position, CTA, OPA.

8. The camshaft adjuster as claimed in claim 1, wherein axial positions of the control piston correspond, with decreasing energization of a central magnet proceeding from a fully energized position, to a sequence of modes as follows: intermediate or central position, OPA, CTA, regulated position, CTA, OPA.

9. The camshaft adjuster as claimed in claim 1, wherein the camshaft adjuster has a locking mechanism which is activated by axial positions of the control piston which correspond to CTA and central position modes.

10. The camshaft adjuster as claimed in claim 1, wherein the camshaft adjuster has a restoring spring, a torque of which acts on the positioning element counter to a drag torque of the camshaft.

* * * * *